US006271742B1

(12) United States Patent
Graf

(10) Patent No.: US 6,271,742 B1
(45) **Date of Patent: *Aug. 7, 2001**

(54) MAINS ADAPTER AND METHOD FOR ITS PRODUCTION

(75) Inventor: Michael Graf, Lenzburg (CH)

(73) Assignee: Aspro Technology AG, Niederlenz (CH)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/377,728

(22) Filed: Aug. 19, 1999

(30) Foreign Application Priority Data

Jul. 27, 1999 (CH) ..... 1376/99

(51) Int. Cl.[7] ..... H01F 27/02; H01F 27/29
(52) U.S. Cl. ..... 336/96; 336/90; 336/192
(58) Field of Search ..... 336/90, 96, 59, 336/192

(56) References Cited

U.S. PATENT DOCUMENTS

| | | | | |
|---|---|---|---|---|
| 2,930,011 | * | 3/1960 | Wigert et al. | 336/96 |
| 2,942,214 | * | 6/1960 | Fruengel | 336/192 |
| 3,467,929 | * | 9/1969 | Derbyshire et al. | 336/96 |
| 3,585,450 | * | 6/1971 | Lane | 361/41 |

FOREIGN PATENT DOCUMENTS 0 485 341 A1 5/1992 (EP) .

* cited by examiner

*Primary Examiner*—Anh Mai
(74) *Attorney, Agent, or Firm*—Finnegan, Henderson, Farabow, Garrett, & Dunner, L.L.P.

(57) ABSTRACT

The iron core (2) and the windings (3, 4) of a transformer (1) are held together by a coil former (21) which is arranged in an injection mould in such a way that it comes into contact with said mould only with small parts at its surface, whereas the transformer (1) is a distance away from its walls. A plastic shell (22) is then moulded on to complete a small and light integral casing (7) enclosing the transformer all round and in an abutting manner. Joints between the coil former (21) and the shell (22) are essentially at the bottom of indentations which separate cooling fins (20).

43 Claims, 5 Drawing Sheets

MAINS ADAPTER AND METHOD FOR ITS PRODUCTION

FIELD OF THE INVENTION

The invention relates to a mains adapter and a method for its production. Mains adapters are used for stepping down the mains voltage so that electrical equipment requiring low voltage, such as, for example, chargers, can be operated thereon.

DESCRIPTION OF THE RELATED ART

European Patent No. EP-A-0 485 341 discloses a mains adapter of the generic type, in which the transformer held together by an integrally moulded holder is surrounded by a mould sleeve, which however leaves large parts of the surface of the transformer free. To ensure that the transformer is completely encased, the mains adapter of the generic type therefore additionally comprises a housing which surrounds the partly encased transformer in part with a spacing. The mains adapter therefore has a relatively large volume. Its production requires insertion of the transformer into the housing after preliminary injection moulding steps, in which, on the one hand, the transformer was completed and, on the other hand, the parts of the housing were produced, and is therefore relatively complicated.

SUMMARY OF THE INVENTION

It is the object of the invention to provide a mains adapter of the generic type which can be designed to be very small and can be produced simply and cheaply. This object is achieved by an integral plastic casing completely enclosing the transformer in an abutting manner, so as to permit only contact elements and connections to extend through the casing and connect to the transformer. In addition, the present invention intended to provide a particularly suitable, very simple and cheap method for the production of a mains adapter. These exemplary objects the invention. This object are achieved by the steps providing a transform including an iron core, a primary winding, and a secondary winding; providing a coil former configured for supporting the iron core, the primary winding and the secondary winding of the transformer; providing an integral shell shaped for covering at least one portion of an outer surface of the transformer; arranging the transformer and the coil former in an injection mould while the coil former supports the iron core, primary winding and secondary winding of the transformer; and moulding the integral shell onto the transformer and the coil former so as to form an integral plastic casing completely enclosing the transformer in an abutting manner, thereby permitting only contact elements and connections to extend through the casing and connect to the transformer.

The advantages achieved by the present invention lie essentially in the fact that no additional housing is required. As a result the mains adapter according to the invention is very small and light and hence easy to accommodate and convenient to transport. Moreover, the mains adapter of the present invention is not only extremely stable, with regard to mechanical or structural properties, but also meets the usual safety requirements with regard to its electrical properties. The mains adapter of the present invention also removes heat in an improved manner. In addition, the present invention includes manufacturing such a main adapter in an extremely simple manner and consuming materials in an efficient matter.

BRIEF DESCRIPTION OF THE DRAWINGS

The invention is explained in more detail below with reference to Figures, which represent merely an embodiment.

DESCRIPTION OF THE PREFERRED EMBODIMENTS

Figure 1A:
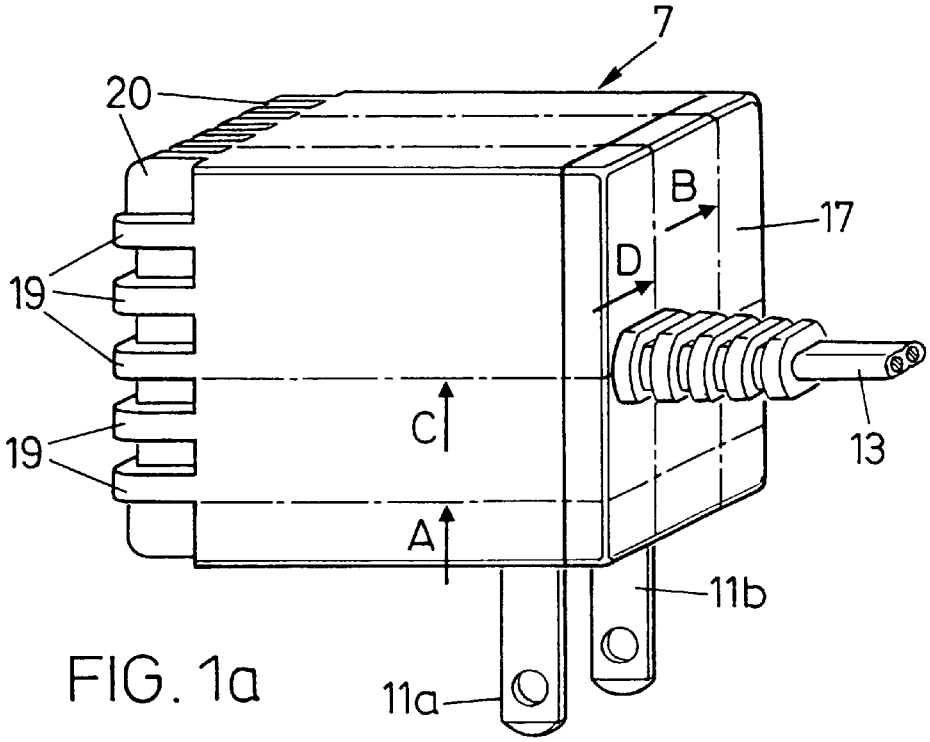
FIG. 1*a* shows a perspective view of a mains adapter according to the invention.

The mains adapter has a transformer 1 with an iron core 2 consisting of E-shaped and I-shaped laminations and with a primary winding 3 and a secondary winding 4 which, axially in succession, surround a central yoke 5 of the iron core 2, which is flanked by outer yokes 6*a, b.*

The transformer 1 is completely enclosed by a plastic casing 7 which rests against its entire outer surface. Only various wired connections in the form of connecting pins, namely a primary connection 8*a* and secondary connections 9, are led through the casing 7. One end of the primary winding 3 is connected to a first contact pin 11*a* via the primary connection 8*a* and a fuse 10 connecting thereto, while a second contact pin 11*b* is connected directly to a primary connection 8*b*, a piece of winding wire drawn from the other end of the primary winding 3. The secondary winding 4 is connected to a cable 13 via the secondary connections 9 and a circuit 12. The circuit 12 may comprise, for example, a rectifier and a smoothing capacitor.

The connections 8*a*, 9 are led out on the same side from the housing 7, where they enter an indentation 14 in which the fuse 10 and the circuit 12 are also arranged. The indentation 14 is surrounded by an all-round side wall 15. In addition, the primary connection 8*a* is separated from the secondary connections 9 by an approximately U-shaped partition 16, the ends of which adjoin the side wall 15. The indentation 14 is closed by a cover 17 through which the cable 13 is led. The cover 17 has an opposite wall 18 which, when the cover 17 is mounted, runs a small lateral distance away from the cover inside the partition 16 and overlaps with it. As a result of this separation of the primary side from the secondary side, arc-overs or leakage currents between them are virtually ruled out. On the back, the casing 7 has continuous cooling fins 19 and further cooling fins 20, running transversely thereto, on opposite edges.

The casing 7 is composed of two parts. The first part is a coil former 21, a prefabricated one-piece injection moulded part, which is wound with the primary winding 3 and the secondary winding 4 and into which thereafter an E-shaped lamination is inserted alternately from each of two sides and an I-shaped lamination from the other side for the formation of the iron core 2. It also carries the contact pins 11*a,b*, which are anchored in it and project from the casing 7 below the side wall 15 of the indentation 14, parallel to the plane defined by its edge. The second part is a shell 22 which covers the larger part of the outer surfaces of the iron core 2 and of the windings 3, 4 and also forms the predominant part of the outer surface of the casing 7, but also separating layers between the primary winding 3 and the secondary winding 4 on the one hand and the outer yokes 6*a,b* of the iron core 2 on the other hand. The coil former 21 and the shell 22 are fused together at the joints so that the finished casing 7 is integral. It hermetically seals the transformer 1, and does so by being directly adjacent to its outer surface all round, and, apart from the cover 17 and the contact pins 11*a,b*, forms the total outer surface of the mains adapter. It is therefore very compact and the space it requires is very small. Thanks to the compact design and the close connection of its parts, the mechanical stability of said mains adapter is excellent. For the same reasons, it is also not susceptible to oscillations so that pulsed delivery of the output power is possible without problems. Owing to the close encasing which does not enclose air layers, the heat removal too is excellent and permits high power density.

Figure 1B:
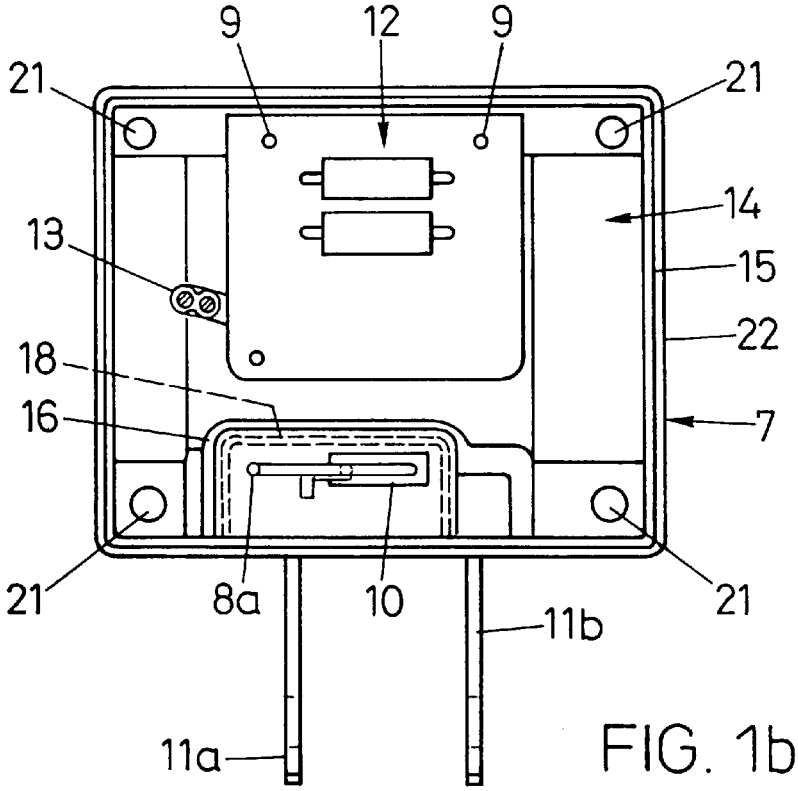
FIG. 1*b* shows a plan view of the mains adapter according to FIG. 1*a*, with the cover removed.

The coil former forms only one small part of the outer surface of the casing 7, in particular at the base of the three middle cooling fins of the further cooling fins 20, alternatively referred to as the three cooling fin base portions, and at the intermediate spaces between them and at points on the opposite side of the casing 7, i.e. in the indentation 14 (FIG. 1*b*). The joint between the coil former 21 and the shell 22 is therefore evident only in lower-lying, poorly visible areas and in areas concealed by the cover 17. The coil former 21 and the shell 22 consist of the same material, e.g. polyamide, polycarbonate or ABS.

Figure 2A:
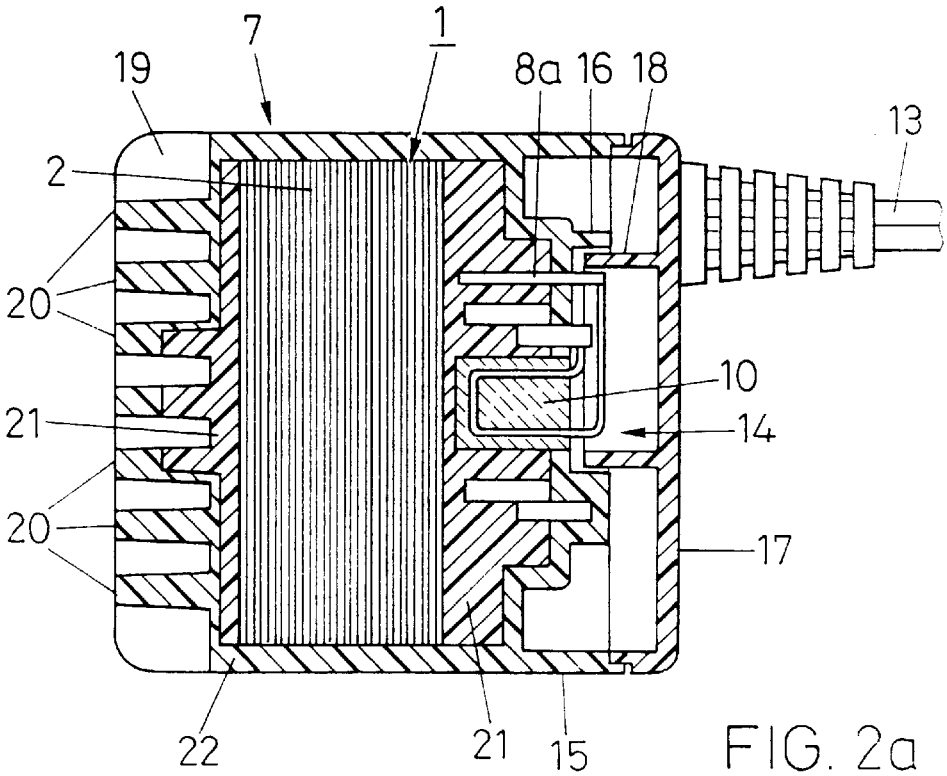
FIG. 2*a* shows a horizontal section along the plane A through the mains adapter according to FIG. 1*a,*
Figure 2B:
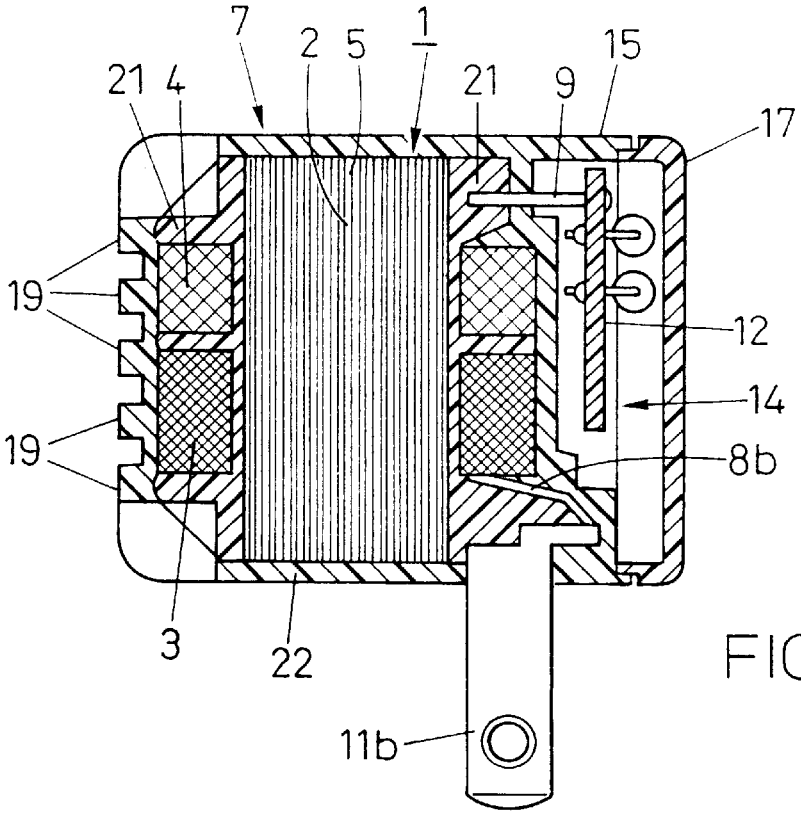
FIG. 2*b* shows a vertical section along the plane B through the mains adapter according to the invention and according to FIG. 1*a,*
Figure 2C:
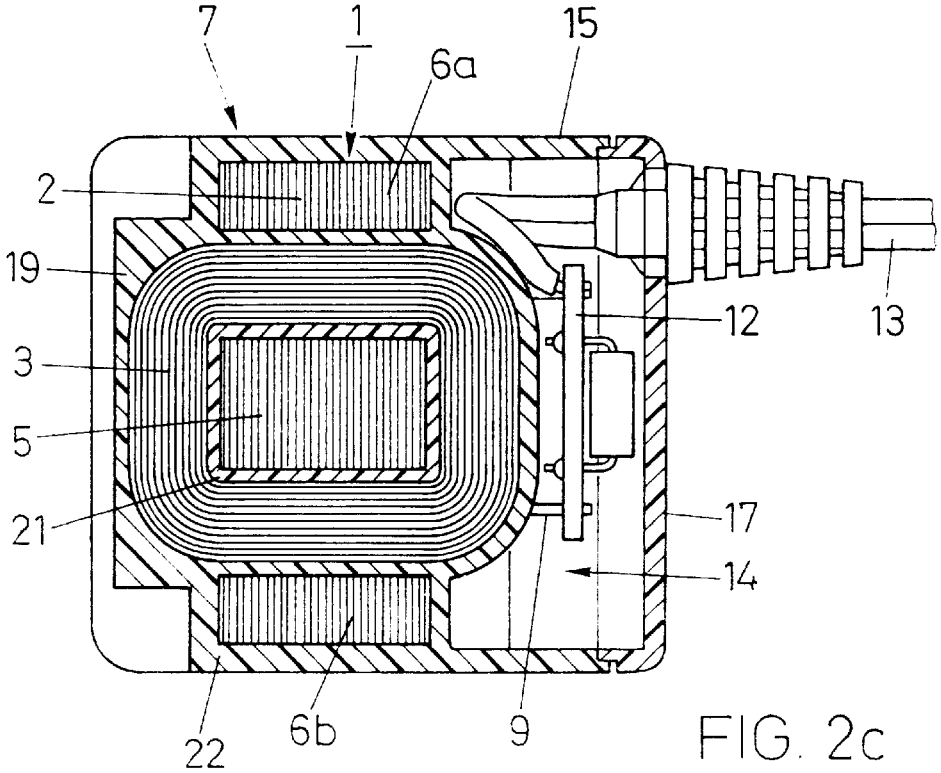
FIG. 2*c* shows a horizontal section along the plane C through the mains adapter according to the invention and according to FIG. 1*a,*
Figure 2D:
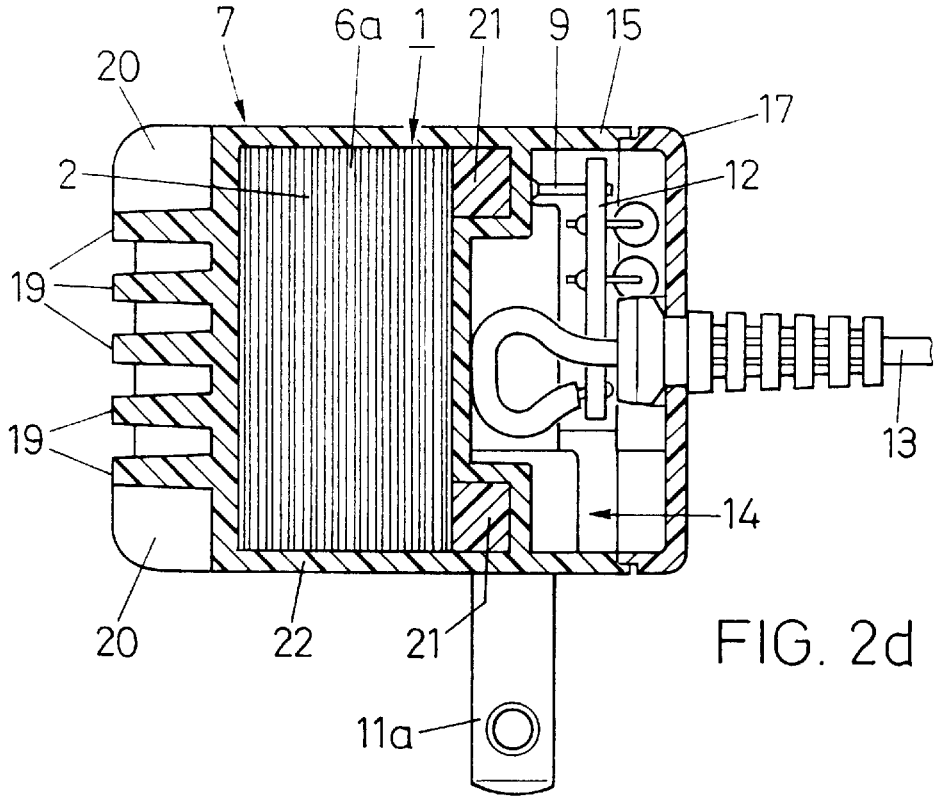
FIG. 2*d* shows a vertical section along the plane D through the mains adapter according to the invention and according to FIG. 1*a,*
Figure 3:
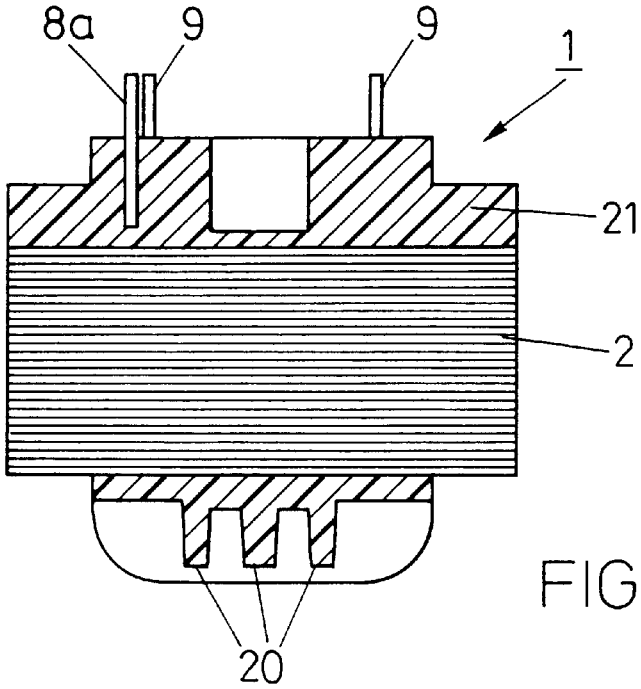
FIG. 3 shows a section through a transformer and coil former of a slightly modified embodiment of the mains adapter according to the invention and according to FIG. 1*a,*
Figure 4:
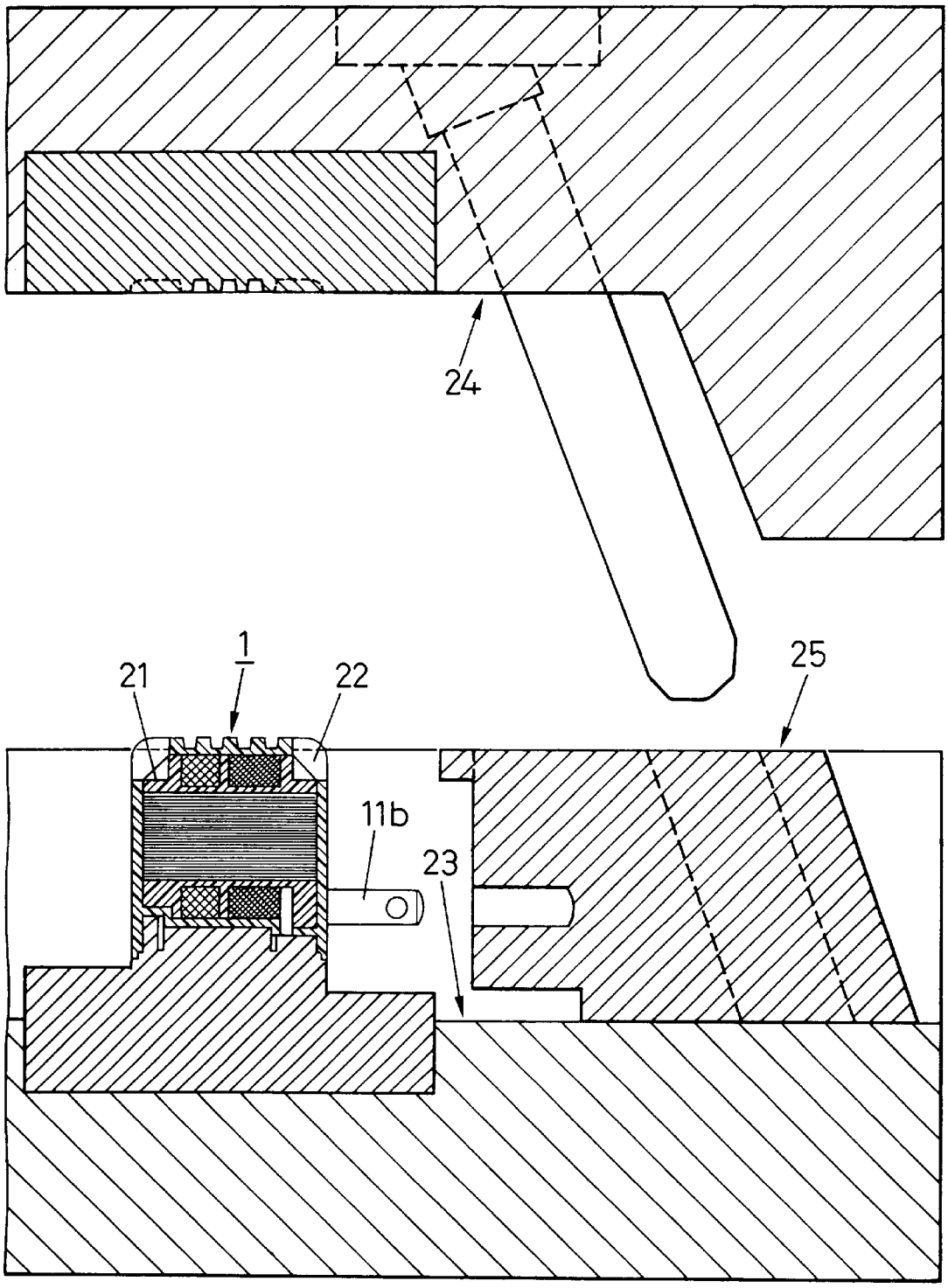

For the production of the mains adapter according to the invention (FIGS. 3 to 5), the transformer 1, which is shown in FIG. 3 in a section corresponding sectional plane of FIG. 2*a*, for example is first assembled by winding the coil former 21, inserting the connecting pins for forming the primary connections 8*a,b* and secondary connections 9 therein and soldering them to the ends of the windings 3, 4 and then mounting the contact pins 11*a,b* and the iron core 2. The iron core and windings are connected to the coil former 21 so that there is no mutual shifting of these parts in the following production steps.

The transformer 1 is then placed in an injection mould having a base 23, an upper slide 24 and lateral slides 25 and the injection mould is closed. It rests in each case only with small parts of the coil former 21 against the walls of the injection mould, while the iron core 2 and the windings 3, 4 are a distance away therefrom. In particular, the bases of the middle cooling fins among the further cooling fins 20 rest on the base 23 while small sections of the opposite surface of the coil former 21 are in contact with the upper slide 24 and are held down by it (cf. FIG. 1*b*) so that the transformer 1 is fixed nondisplaceably in the injection mould. The fixing is further reinforced by the fact that the connections 8*a*, 9 are held in corresponding recesses in the wall of the upper slide 24 and the contact pins 11*a,b* in recesses of the appropriate lateral slide 25.

Figure 5:
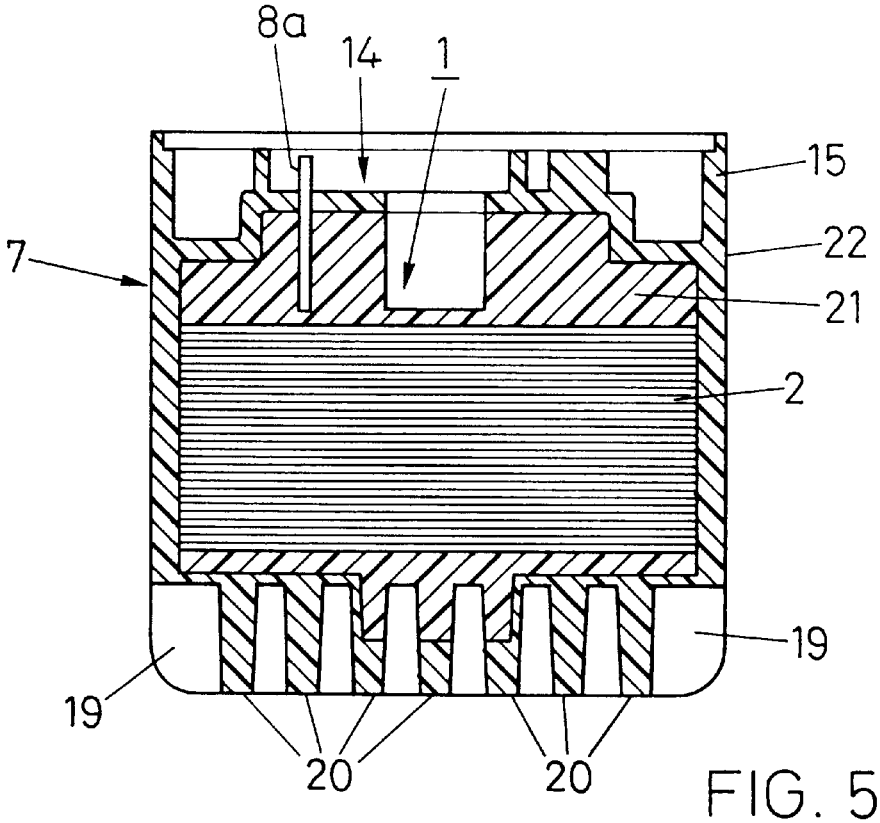
FIG. 4 shows a section through the transformer with coil former corresponding to FIG. 3 in an injection mould and FIG. 5 shows a section corresponding to FIG. 3 through a mains adapter according to the invention.

Finally, the shell 22 is moulded on and the casing 7 is thus completed. The coil former 21 is slightly fused on at the joint with the shell 22 and connects tightly thereto. Only those sections of the surface of the coil former 21 which are in contact with the wall of the injection mould and have already been described further above rest against the outer surface of the casing 7, while the predominant part thereof is formed by the shell 22. The connecting pins and contact pins arranged in a protected manner in recesses remain bare. Finally, the injection mould is opened again (FIG. 4) and the virtually ready mains adapter is removed (FIG. 5).

It is also possible to fix the coil former by retractable retaining parts, in particular retaining pins in the injection mould and to retract said parts after the shell has been moulded on and to carry out subsequent injection moulding. In this case, the coil former—apart from connecting pins and contact pins—is completely encased and its outer surface is formed entirely by the shell.

The cover 17 is produced separately, likewise by the injection moulding method. Finally, the mains adapter is assembled by connecting the fuse 10, the circuit 12 and the cable 12 and mounting the cover 17 on the casing 7 and welding it or screwing it to said casing. Because the connections led out are all arranged on one side, not only is the injection moulding process facilitated but also the steps mentioned are all carried out from this single side so that they can be effected without changing the position and can easily and quickly be performed manually as well as automatically. The same casing can be used to connect covers of different heights, so that the available space can be adapted to the space requirement of the wiring.

What is claimed is:

1. A mains adapter comprising:

a transformer having an iron core, a primary winding and a secondary winding;

a plurality of primary electrical connections conductively connected to the primary winding of the transformer;

a plurality of secondary electrical connections conductively connected to the secondary winding of the transformer; and a plastic casing completely enclosing the transformer in an abutting manner permitting only the primary electrical connections and the secondary electrical connections to extend through the casing.

2. The mains adapter of claim 1, wherein the casing includes a coil former supporting the iron core, the primary winding, and the secondary winding of the transformer, and a shell covering at least one portion of an outer surface of the transformer.

3. The mains adapter of claim 2, wherein the outer surface of the casing is formed at least partly by the coil former.

4. The mains adapter of claim 3, wherein the casing includes a plurality of cooling fins and the coil former forms a portion of the outer surface of the casing that lies partly between the cooling fins.

5. The mains adapter of claim 1, wherein at least one of the primary electrical connections and at least one of the secondary electrical connections extend away from the same side of the casing.

6. The mains adapter of claim 5, wherein the primary electrical connections are separated from the secondary electrical connections by a partition.

7. The mains adapter of claim 6, further comprising a contact pin conductively connected to at least one of the primary electrical connections and extending away from the casing along a direction parallel to a surface of the side from which the at least one primary electrical connection extends.

8. The mains adapter of claim 7, wherein the casing includes a coil former supporting the iron core, the primary winding, and the secondary winding, and the contact pin is anchored in the coil former.

9. The mains adapter of claim 5, further comprising a cover supported on a sidewall of the casing to conceal the secondary electrical connections extending through the casing.

10. The mains adapter of claim 9, wherein the cover has an opposite wall extending parallel to a side surface of a partition and spaced a small distance away from the side surface of the partition so as to overlap with the side surface of the partition.

11. The mains adapter of claim 9, further comprising at least one electrical circuit conductively connected to at least one of the secondary electrical connections extending through the casing, and a cover supported on a sidewall of the casing to conceal at least one of the secondary electrical connections extending through the casing.

12. The mains adapter of claim 1, further comprising a cover supported on a sidewall of the casing to conceal the secondary electrical connections extending through the casing.

13. The mains adapter of claim 12, wherein the cover has an opposite wall extending parallel to a side surface of a partition and spaced a small distance away from the side surface of the partition so as to overlap with the side surface of the partition.

14. The mains adapter of claim 12, further comprising at least one electrical circuit conductively connected to at least one of the secondary electrical connections extending through the casing, and a cover supported on a sidewall of the casing to conceal the at least one of the secondary connections extending through the casing.

15. The mains adapter of claim 1, further comprising a first contact element and a second contact element anchored in the casing and extending beyond a surface of the casing.

16. The mains adapter of claim 15, wherein the contact elements are contact pins extending away from the surface of the casing.

17. The mains adapter of claim 1, wherein the primary electrical connections are separated from the secondary electrical connections by a partition.

18. The mains adapter of claim 17, further comprising a contact pin conductively connected to at least one of the primary electrical connections and extending away from the casing along a direction parallel to a surface of the side from which the at least one of the primary electrical connections extends.

19. The mains adapter of claim 1, further comprising a fuse conductively connected to at least one of the primary electrical connections, a cover concealing the fuse and the at least one primary electrical connection, and a contact pin conductively connected to the fuse and extending away from an outer surface of the casing.

20. The mains adapter of claim 1, further comprising a circuit conductively connected to at least one of the secondary electrical connections, a cover concealing the circuit, and a transmission cable conductively connected to the circuit and extending away from an outer surface of the cover.

21. The mains adapter of claim 1, further comprising at least one contact pin conductively connected to at least one of the primary electrical connections and extending along a first direction away from a side of the casing, and a transmission cable conductively connected to the at least one secondary electrical connection and extending away from a side of the cover along a second direction perpendicular to the first direction.

22. The mains adapter of claim 1, wherein at least one contact element is electrically conductively connected to the primary winding via a fuse and one of the primary electrical connections.

23. The mains adapter of claim 1, wherein at least one of the primary electrical connections includes at least one contact element electrically conductively connected to the primary winding.

24. The mains adapter of claim 1, further comprising an electrical circuit electrically conductively connected to at least one of the secondary electrical connections.

25. The mains adapter of claim 1, further comprising a transmission cable electrically conductively connected to the secondary electrical connections.

26. A mains adapter comprising:

a transformer having an iron core, a primary winding and a secondary winding;

a plurality of primary electrical connections conductively connected to the primary winding of the transformer;

a plurality of secondary electrical connections conductively connected to the secondary winding of the transformer;

an integral plastic casing completely encapsulating the transformer in an abutting manner permitting only the primary electrical connections and the secondary electrical connections to extend through the casing; and wherein the casing includes a coil former supporting the iron core, the primary winding and the secondary winding of the transformer, and a shell covering at least one portion of an outer surface of the transformer, and the outer surface of the casing is formed at least partly by the coil former.

27. The mains adapter of claim 26, further comprising a circuit conductively connected to at least one of the secondary electrical connections, a cover concealing the circuit, and a transmission cable conductively connected to the circuit and extending away from an outer surface of the cover.

28. The mains adapter of claim 26, further comprising at least one contact pin extending from a side of the casing, and wherein at least one of the primary electrical connections extends through a portion of the coil former to conductively connect the contact pin to the primary winding of the transformer.

29. The mains adapter of claim 26, further comprising at least one contact pin conductively connected to at least one of the primary electrical connections and extending along a first direction away from a side of the casing, and a transmission cable conductively connected to at least one of the secondary electrical connections and extending away from a side of the cover along a second direction perpendicular to the first direction.

30. The mains adapter of claim 26, wherein the casing includes a plurality of cooling fins and the coil former forms a portion of the outer surface of the casing that lies partly between the cooling fins.

31. The mains adapter of claim 26, further comprising a fuse conductively connected to the at least one of the primary electrical connections, a cover concealing the fuse and the at least one primary electrical connection, and a contact pin conductively connected to the fuse and extending away from an outer surface of the casing.

32. A method for producing a mains adapter comprising the steps of:

providing a transformer having an iron core, a primary winding, and a secondary winding;

providing a plurality of primary electrical connections conductively connected to the primary winding of the transformer;

providing a plurality of secondary electrical connections conductively connected to the secondary winding of the transformer;

providing a coil former configured for supporting the iron core, the primary winding and the secondary winding of the transformer;

providing an integral shell shaped for covering at least one portion of an outer surface of the transformer;

arranging the transformer and the coil former in an injection mould while the coil former supports the iron core, primary winding and secondary winding of the transformer; and moulding the integral shell onto the transformer and the coil former to form an integral plastic casing completely enclosing the transformer in an abutting manner permitting only the primary electrical connections and the secondary electrical connections to extend through the casing.

33. The method of claim 32, wherein the step of arranging includes the substeps of providing at least one wall of the injection mould to support an outer surface of the coil former while an inner surface of the coil former supports the iron core, primary winding and secondary winding, and spacing the iron core, the primary winding, and the secondary winding of the transformer, with the exception of the primary and secondary electrical connections a distance away from the at least one wall of the injection mould.

34. The method of claim 32, further comprising the step of holding the transformer and the coil former in the injection mould by fixing retractable retaining parts only to the coil former during the step of moulding the shell onto the transformer and the coil former and the step of retracting the retaining parts after the step of moulding.

35. The method of claim 32, wherein the step of providing the coil former includes the substep of forming at least one cooling fin base portion and the step of moulding the integral shell includes the substep of forming at least one cooling fin onto the at least one cooling fin base portion.

36. A mains adapter having a transformer which includes an iron core, a primary winding, a secondary winding, comprising:

an integral plastic casing completely enclosing the transformer in an abutting manner, so as to permit only contact elements and connections to extend through the casing and connect to the transformer;

wherein the connections comprise at least one primary connection and at least one secondary connection separated from the at least one primary connection by a partition, the connections being concealed by a cover having an opposite wall extending parallel to a side surface of the partition and spaced a small distance away from the side surface of the partition so as to overlap with the side surface of the partition.

37. The mains adapter of claim 36, further comprising at least one electrical circuit concealed by the cover and arranged in the region of the connections extending through the casing.

38. The mains adapter of claim 36, wherein the contact elements comprise contact pins projecting away from the casing along a direction parallel to a surface of the side from which the connections extend.

39. The mains adapter of claim 38, wherein the contact pins are anchored in the coil former.

40. A mains adapter comprising:

a transformer having an iron core, a primary winding and a secondary winding;

a plurality of primary electrical connections conductively connected to the primary winding of the transformer;

a plurality of secondary electrical connections conductively connected to the secondary winding of the transformer;

an integral plastic casing completely enclosing the transformer in an abutting manner permitting only the primary electrical connections and the secondary electrical connections to extend through the casing;

a cover supported on the casing to conceal the secondary electrical connections; and wherein the secondary electrical connections comprise first and second secondary connections each conductively connected to the secondary winding and extending away from the same side of the casing.

41. The mains adapter of claim 40, further comprising a fuse conductively connected to at least one of the primary electrical connections and concealed by the cover, and a contact pin conductively connected to the fuse and extending away from an outer surface of the casing.

42. The mains adapter of claim 40, further comprising a circuit conductively connected to at least one of the first and second secondary connections and concealed by the cover, and a transmission cable conductively connected to the circuit and extending away from an outer surface of the cover.

43. The mains adapter of claim 40, further comprising at least one contact pin conductively connected to at least one of the primary electrical connections and extending along a first direction away from a side of the casing, and a transmission cable conductively connected to at least one of the first and second secondary connections and extending away from a side of the cover along a second direction perpendicular to the first direction.

* * * * *